US007494072B2

(12) United States Patent
Hasegawa

(10) Patent No.: US 7,494,072 B2
(45) Date of Patent: Feb. 24, 2009

(54) FLUID SPRAYING DEVICE AND FLUID SPRAYING NOZZLE

(75) Inventor: Kaga Hasegawa, Tokyo (JP)

(73) Assignee: Ga-Rew Corporation (JP)

( * ) Notice: Subject to any disclaimer, the term of this patent is extended or adjusted under 35 U.S.C. 154(b) by 504 days.

(21) Appl. No.: 10/936,844

(22) Filed: Sep. 9, 2004

(65) Prior Publication Data

US 2005/0056709 A1 Mar. 17, 2005

(30) Foreign Application Priority Data

Sep. 11, 2003 (JP) ..... 2003-320099
Feb. 27, 2004 (JP) ..... 2004-053908
Feb. 27, 2004 (JP) ..... 2004-053909

(51) Int. Cl.
*B05B 7/06* (2006.01)

(52) U.S. Cl. ..... 239/427; 239/229; 239/317; 239/398; 239/428; 239/434; 239/602

(58) Field of Classification Search ..... 239/398, 239/427, 427.3, 428, 434, 429, 430, 403, 239/400, 433, 423, 432, 498, 602, 317, 504
See application file for complete search history.

(56) References Cited

U.S. PATENT DOCUMENTS 3,109,594 A 11/1963 Pletcher
3,837,915 A 9/1974 Erb
5,035,358 A * 7/1991 Katsuno et al. ..... 239/403
5,533,673 A * 7/1996 Wilson et al. ..... 239/227
5,868,321 A * 2/1999 Haruch ..... 239/399
6,276,617 B1 8/2001 Lenhardt
6,808,122 B2 * 10/2004 Mitcheli ..... 239/11

FOREIGN PATENT DOCUMENTS

DE 12 69 065 B 5/1968
DE 100 65 825 A 7/2002
JP 2000 051800 A 2/2000
SU 1212606 2/1986

OTHER PUBLICATIONS

European Search Report for Application No. 04021430.6-2425 dated May 14, 2005.

* cited by examiner

*Primary Examiner*—Dinh Q Nguyen
(74) *Attorney, Agent, or Firm*—Cantor Colburn LLP

(57) ABSTRACT

A fluid spraying device comprises a first supply flow path which guides a pressurized liquid, a second supply flow path which guides a pressurized gas, a gas-liquid mixing part which joins the first supply flow path and the second supply flow path and which mixes the liquid and the gas, and an ejection flow path which guides a fluid from the gas-liquid mixing part to the outside. A branching/joining part is provided at an intermediate part of the ejection flow path which, after branching the ejection flow path into a plurality of branch flow paths, rejoins these branch flow paths together. Moreover, a fluid spraying nozzle comprises a flexible spray tube, and a guide which surrounds the spray tube from the outside in the diametral direction. A ring-shaped tube side-magnet is provided on the spray tube, a ring-shaped guide side magnet is provided on the guide, and the polarity of the outer peripheral side of the tube side magnet and the polarity of the inner peripheral side of the guide side magnet have the same polarity.

4 Claims, 5 Drawing Sheets

FLUID SPRAYING DEVICE AND FLUID SPRAYING NOZZLE

BACKGROUND OF THE INVENTION

1. Field of the Invention

This invention relates to a fluid spraying device and a fluid spraying nozzle to be used therein.

Priority is claimed on Japanese Patent Application No. 2003-320099 filed Sep. 11, 2003, and Japanese Patent Application Nos. 2004-53908 and 2004-53909 filed Feb. 27, 2004, the contents of which are incorporated herein by reference.

2. Description of Related Art

A fluid spraying device which mixes and ejects a gas and a liquid comprises: a compressed air supply means which supplies compressed air; a water supply means which pumps water; a detergent supply means which pumps a detergent; and a washing gun which is connected to the compressed air supply means, the water supply means, and the detergent supply means, and which comprises a nozzle. The washing gun is capable of switching between a state of mixing the compressed air and the water and ejecting it from the nozzle, and a state of mixing the compressed air and the detergent and ejecting it from the nozzle (refer to Japanese Unexamined Patent Application, First Publication No. 2000-51800, for example).

A nozzle which is used in the above-mentioned fluid spraying device comprises a flexible spray tube and a cone-shaped guide which surrounds the spray tube from the outside in the diametral direction. The spray tube is made to traverse along the guide by means of a force that results when a fluid flows through the spray tube and is ejected from the spray tube (refer to Japanese Unexamined Patent Application, First Publication No. 2001-104840, for example).

During washing of an article, when a liquid for washing is ejected, the smaller the drops of the liquid are, the more it becomes possible to increase the washing performance by reducing the effect on the object to be washed, and it is possible to carry out effective washing with a small liquid volume, Moreover, even when ejecting a liquid for coating such as a coating agent onto an object to be coated, the smaller the drops of the liquid are, the more it becomes possible to carry out effective coating with a small liquid volume.

SUMMARY OF THE INVENTION

Therefore, the first object of this invention is to provide a fluid spraying device with which it is possible to increase the washing performance or coating performance by making the drops of liquid smaller, and with which it is possible to carry out effective washing or coating with a small liquid volume.

Furthermore, in the above-mentioned fluid spraying nozzle, as the traversing speed of the spray tube increases, the washing performance when used in a washing device and the coating performance when used in a coating device increase. However, if the spray tube traverses while sliding with respect to the guide, then a sliding resistance is generated, and this affects the traversing speed of the spray tube.

Therefore, the second object of this invention is to provide a fluid spraying nozzle which can further increase the traversing speed of the spray tube, and a fluid spraying device which uses this fluid spraying nozzle.

In order to achieve the above-mentioned objects, the fluid spraying device according to a first aspect of the invention comprises a first supply flow path which guides a pressurized liquid, a second supply flow path which guides a pressurized gas, a gas-liquid mixing part which joins the first supply flow path and the second supply flow path and which mixes the liquid and the gas, and an ejection flow path which guides a fluid from the gas-liquid mixing part to the outside, A branching/joining part is provided at an intermediate part of the ejection flow path which, after branching the ejection flow path into a plurality of branch flow paths, rejoins these branch flow paths together.

According to this aspect of the invention, the pressurized liquid which has been guided via the first supply flow path and the pressurized gas which has been guided via the second supply flow path are mixed in the gas-liquid mixing part which joins the first supply flow path and the second supply flow path. Therefore, the fluid is made into small drops when mixed in this way. The gas-liquid mixture fluid of the liquid and the gas which have been mixed in this way is guided to the outside via the ejection flow path, and along the way, they collide into each other when they are rejoined together after being branched into the plurality of branch flow paths in the branching/joining part. As a result, the liquid is made into even smaller drops. Accordingly, when ejecting a liquid for washing such as water or a detergent, the washing performance is increased, and it is possible to carry out effective washing with a small liquid volume. Furthermore, when ejecting a liquid for coating such as a coating agent, the coating performance is increased, and it is possible to carry out effective coating with a small liquid volume.

In a second aspect of the invention, the fluid spraying device of the first aspect of the invention further comprises a flexible spray tube which constitutes the rear or downstream end of the ejection flow path, and a cone-shaped guide which is disposed outside of the spray tube in the diametral direction so that the large diameter side is positioned at the front end side.

According to this aspect of the invention, when the gas-liquid mixture fluid which has been branched into a plurality of branch flow paths and then rejoined together in the branching/joining part is ejected from the spray tube, the spray tube traverses along the cone-shaped guide at a high speed. Therefore, the gas-liquid mixture fluid which is to be ejected from the spray tube traverses as the spraying position is shifted. As a result, it is possible to further increase the washing performance during washing, and to further increase the coating performance during coating.

In a third aspect of the invention, a fluid spraying device comprises a flexible spray tube, a fluid spray nozzle provided with a guide which surrounds the spray tube from the outside in the diametral direction, and a fluid pumping means which pumps a fluid to the spray tube. A ring-shaped tube side magnet is provided on the spray tube, and a ring-shaped guide side magnet is provided on the guide. The polarity of the outer peripheral side of the tube side magnet and the polarity of the inner peripheral side of the guide side magnet have the same polarity.

In a fourth aspect of the invention, a fluid spraying device comprises a flexible spray tube, a fluid spraying nozzle which is provided with a guide that surrounds the flexible tube from the outside in the diametral direction, and a fluid pumping means which pumps a fluid to the spray tube. A ring-shaped tube side magnet is provided on the spray tube, and a ring-shaped guide side magnet is provided on the guide. The polarity of the outer peripheral side of the tube side magnet and the polarity of the inner peripheral side of the guide side magnet have the same polarity.

According to these aspects of the invention, when the flexible spray tube traverses along the guide by a force that results when a fluid flows inside and is ejected, the ring-shaped tube side magnet provided on the spray tube is repelled due to the identical polarity of the ring-shaped guide side magnet provided on the guide which surrounds the spray tube from the outside in the diametral direction. As a result, the spray tube can traverse in a state in which the sliding resistance is greatly reduced if there is no contact or even if there is contact with the guide. Accordingly, it is possible to further increase the traversing speed of the spray tube. As a result, when this spray tube is used in a washing device, it is possible to improve the washing performance, and when it is used in a coating device, it is possible to improve the coating performance. Furthermore, since water molecule clusters are reduced by the magnetic force when passing through the spray tube, it is possible to further improve the washing performance or coating performance.

In a fifth aspect of the invention, the fluid pumping means of the fourth aspect of the invention comprises a first supply flow path which guides a pressurized fluid, a second supply flow path which guides a pressurized gas, a gas-liquid mixing part which joins the first supply flow path and the second supply flow path and which mixes the liquid and the gas, and an ejection flow path which guides a fluid from the gas-liquid mixing part to the spray tube. A branching/joining part is provided at an intermediate part of the ejection flow path which, after branching the ejection flow path into a plurality of branch flow paths, rejoins these branch flow paths together.

According to this aspect of the invention, the pressurized liquid which has been guided via the first supply flow path and the pressurized gas which has been guided via the second supply flow path are mixed in the gas-liquid mixing part which joins the first supply flow path and the second supply flow path. The liquid which has been mixed in this way is made into small drops. The gas-liquid mixture fluid of the liquid and the gas which have been mixed in this way is guided to the spray tube via the ejection flow path. As a result, by means of this aspect of the invention, in addition to the effects of the third and fourth aspects of the invention, it is possible to obtain the same effect as that of the first aspect of the invention.

DETAILED DESCRIPTION OF THE INVENTION

Below, the drawings and the preferred embodiments of the invention will be explained. However, it should be understood that the invention is not limited by the following embodiments, and appropriate combinations of the constituent elements of these embodiments may also be made, for example.

Figure 1:
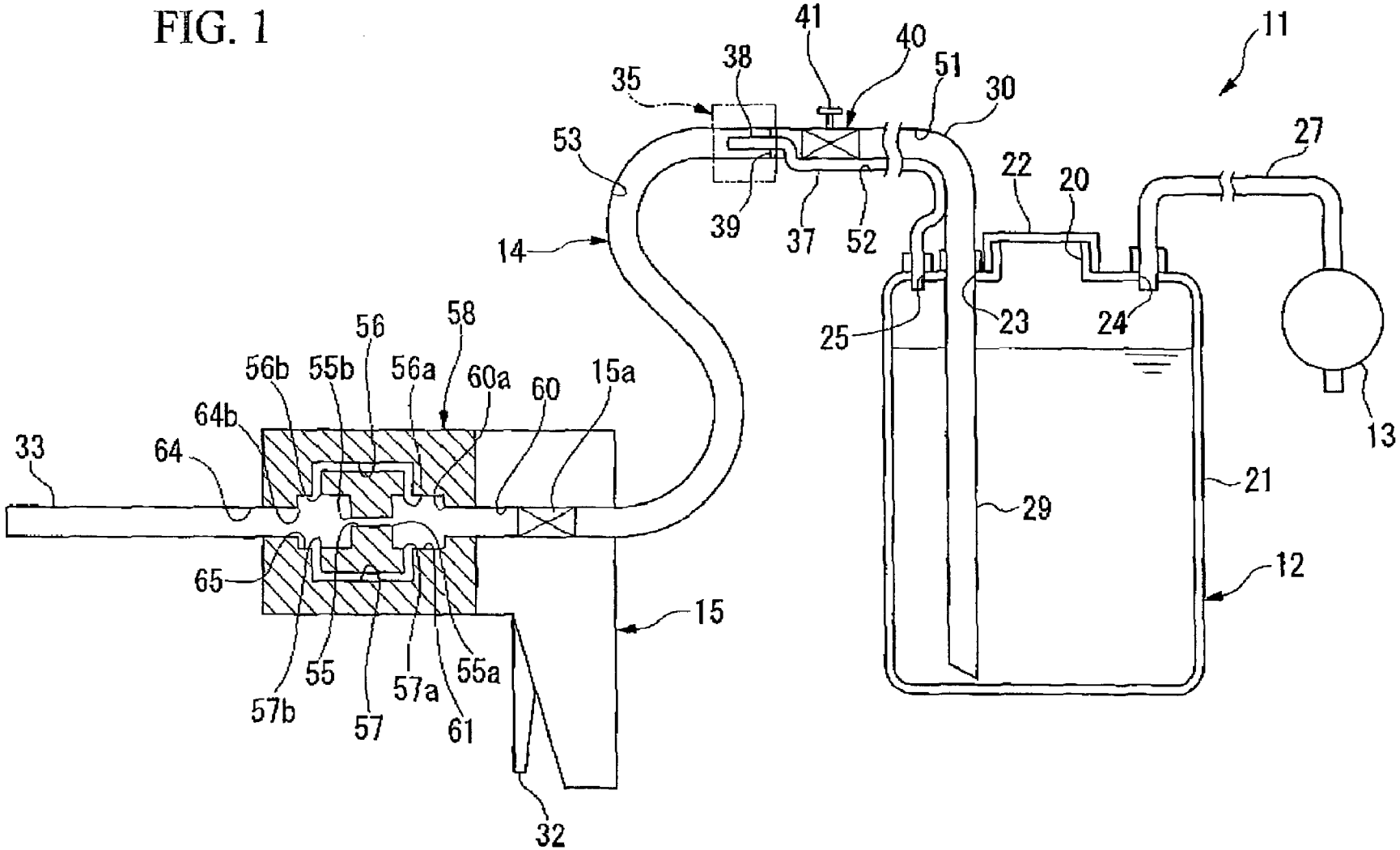
FIG. 1 is a cross-sectional diagram showing an example of a fluid spraying device of this invention.

FIG. 1 is a cross-sectional diagram showing one embodiment of a fluid spraying device according to this invention. A fluid spraying device 11 is used as a washing device for washing an automobile, for example. The fluid spraying device 11 comprises a tank 12 which stores a liquid for washing comprising a detergent or water, an air compressor 13 which pressurizes a liquid by introducing compressed air (gas) into the tank 12, a flexible fluid pipe 14 which guides the liquid inside the tank 12 which was pressurized by the air compressor 13 to the outside, and an opening/closing gun 15 which is attached to the front end of the fluid pipe 14 and which opens and closes a flow path inside the fluid pipe 14.

The tank 12 comprises: a tank main body 21, the top portion of which is provided with a liquid inlet 20 for liquid introduction; and a cover 22 which blocks the liquid inlet 20 by screwing onto the liquid inlet 20 of the tank main body 21. A liquid outlet 23, a gas inlet 24, and a gas outlet 25 are provided in the top portion of the tank main body 21 aligned with the liquid inlet 20.

The air compressor 13 is connected at the discharge side thereof to the gas inlet 24 of the tank main body 21 via piping 27, and compressed air is introduced into the tank 12 from the gas inlet 24.

The fluid pipe 14 is connected to the liquid outlet 23, and comprises an internal pipe part 29 which extends to the vicinity of the bottom part of the tank main body 21, and an external pipe part 30 which is connected to the internal pipe part 29 and which extends outside of the tank 12. The external pipe part 30 has flexibility which allows the generation of pulses in the fluid which passes through the inside.

Since the opening/closing gun 15 is attached to the front end of the external pipe part 30 of the fluid pipe 14, the fluid path inside the fluid pipe 14 can be opened and closed by an internal opening/closing valve 15a due to the rotational operation of a lever 32. An external nozzle 33 which discharges fluid is provided at the front end of the opening/closing gun 15.

The external nozzle 33 is removable with respect to the opening/closing gun 15, and one which is optimally suited for the washing operation is attached.

For example, the following may be alternatively used as the external nozzle 33: a pinpoint nozzle formed into a cylindrical shape which is capable of pin-pointedly ejecting a fluid without deforming while the fluid passes through the inside; a flexible nozzle which can pin-pointedly eject a fluid without deforming while the fluid passes through the inside in addition to being capable of deforming by manual bending or capable of maintaining a deformed state; or a flat nozzle, the entirety of which is formed from a flexible material such as nylon, Teflon (registered trademark), polyurethane, or polypropylene, into a flat shape in which the width in a first direction which is perpendicular to the length direction is smaller than the width in a direction which is perpendicular to the length direction as well as perpendicular to the first direction, wherein the nozzle reciprocates in the first direction while the fluid passes through the inside.

A gas pipe 37 which introduces compressed air into the fluid pipe 14 is inserted into a gas-liquid mixing part 35 which is located at a position along the external pipe part 30 of the fluid pipe 14 (between the tank 12 and the opening/closing gun 15). This gas pipe 37 is connected to the gas outlet 25 of the tank 12 and introduces compressed air, which is introduced into the tank 12 from the air compressor 13, into the fluid pipe 14.

In other words, rather than the gas-liquid mixing part 35 within the fluid pipe 14, it is the tank 12 side that constitutes a first supply flow path 51 which guides a pressurized liquid, and it is the inside of the gas pipe 37 that constitutes a second supply flow path 52 which guides pressurized air. The gas-liquid mixing part 35 joins the first supply flow path 51 and the second supply flow path 52 and mixes the liquid and the gas. Furthermore, rather than the gas-liquid mixing part 35 within the fluid pipe 14, it is the opening/closing gun 15 side, the inside of the opening/closing gun 15, and the inside of the external nozzle 33 that constitute an ejection flow path 53 which guides a fluid from the gas-liquid mixing part 35 to the outside.

A flexible cylindrical internal nozzle 38 which extends toward the opening/closing gun 15 side is provided at the front end part of the gas pipe 37 arranged within the fluid pipe 14. The internal nozzle 38 is supported at its base end by the fluid pipe 14 via a support member 39e The internal nozzle 38 is tubular and the entirety thereof is integrally formed with an approximately uniform thickness from a flexible material such as nylon, Teflon (registered trademark), polyurethane, or polypropylene. A flat shape is formed in at least one part thereof in which the width in a first direction which is perpendicular to the length direction is smaller than the width in a direction which is perpendicular to the length direction as well as perpendicular to the first direction. The nozzle vibrates by reciprocating in only the first direction while the fluid passes through the inside.

An adjustment valve 40 which allows manual adjustment of the opening/closing amount of the flow path inside the fluid pipe 14 is provided closer to the tank 12 side than the position of connecting with the gas pipe 37 of the fluid pipe 14. By rotation of a handle 41 of this adjustment valve 40, it is possible to adjust the flow path inside the fluid pipe 14 to an arbitrary opening degree from fully closed to fully open.

Furthermore, a branching/joining part 58 which, after branching the ejection flow path 53 into a plurality (specifically, three) of branch flow paths 55-57, rejoins these branch flow paths 55-57 together is provided closer to the front end side of the ejection flow path 53 than the internal opening/closing valve 15*a* of the opening/closing gun 15. The external nozzle 33 is provided even closer to the front end side of the branching/joining part 58.

The branching/joining part 58 comprises a branching side enlarged chamber 61 which connects to a base end side flow path 60 that extends from the internal opening/closing valve 15*a* side of the ejection flow path 53. The three branch flow paths 55-57 are branched from this branching side enlarged chamber 61. One branch flow path 55 comprises, on a side face of the branching side enlarged chamber 61, an opening part 55*a* which opposes an opening part 60*a* of the base end side flow path 60. The remaining two branch flow paths 56, 57 comprise, on side faces of the branching side enlarged chamber 61, opening parts 56*a*, 57*a* which are perpendicular to the opening part 60*a* of the base end side flow path 60 and which oppose each other, The cross-sectional areas of the three branch flow paths 55-57 are identical.

The branching/joining part 58 comprises a joining side enlarged chamber 65 which connects to a front end side flow path 64 inside the external nozzle 33. The three branch flow paths 55-57 are joined in this joining side enlarged chamber 65. The three branch flow paths 55-57 are arranged such that each of the axes of opening parts 55*b*-57*b* within the joining side enlarged chamber 65 all meet at one point, i.e., such that the fluids ejected from each of the opening parts 55*b*-57*b* collide. Furthermore, one branch flow path 55 comprises, at a side face of the joining side enlarged chamber 65, the opening part 55*b* which opposes an opening part 64*b* of the front end side flow path 64. The remaining two branch flow paths 56, 57 comprise, at side faces of the joining side enlarged chamber 65, the opening parts 56*b*, 57*b* which are perpendicular to the opening part 64*b* of the front end side flow path 64 and which oppose each other. As a result, the fluids ejected from the branch flow paths 56, 57 collide head on from directions which differ by 180 degrees. The fluid ejected from the branch flow path 55 collides at the position of the head-on collision of the fluids from the branch flow paths 56, 57 from a direction which is perpendicular to these fluids. The opening part 60*a*, the opening pant 55*a*, the opening part 55*b*, and the opening part 64*b* are disposed on the same axis.

Figure 2:
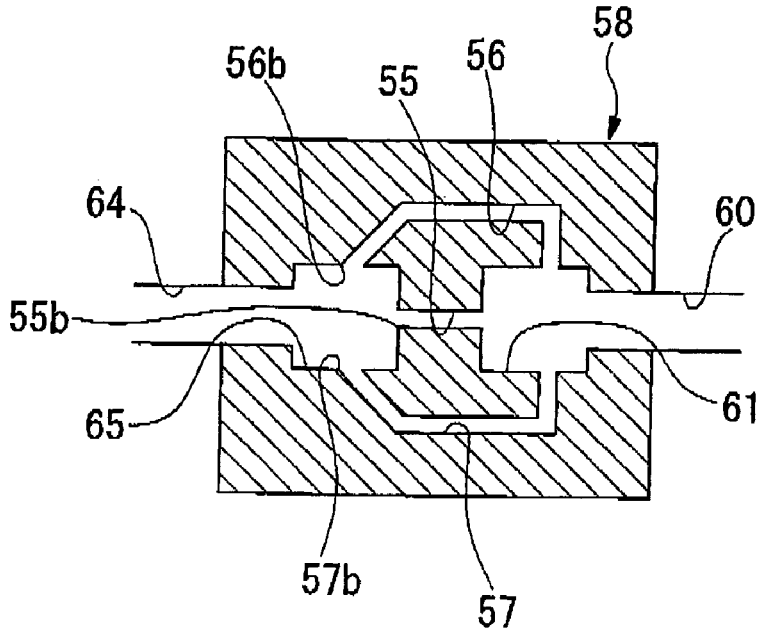
FIG. 2 is a cross-sectional diagram showing another example of the structure of the branching/joining part in the fluid spraying device shown in FIG. 1, FIG, 3 is a diagram showing another example of the structure of the gas supply side and liquid supply side instead of the gas-liquid mixing part in the fluid spraying device shown in FIG. 1.

As shown in FIG. 2, the branch flow paths 56, 57 may also be inclined at an angle of about 45 degrees toward the base end side so that the fluids ejected from the branch flow paths 56, 57 join together each forming an angle of about 45 degrees from the base side end with respect to the fluid ejected from the branch flow path 55 in the joining side enlarged chamber 65 of the branching/joining part 58.

An explanation will be made of the operation for the case when the fluid spraying device 11 having the above-mentioned constitution is used for washing.

First, the cover 22 is removed, a liquid for washing, specifically water, is introduced into the tank main body 21 via the liquid inlet 20 such that the liquid surface is at a position lower than the gas inlet 24 and the gas outlet 25. The liquid inlet 20 is then sealed by the cover 22. In this state, when compressed air is introduced into the tank 12 by the air compressor 13, the water inside the tank 12 is pressurized.

When an operator sets the internal opening/closing valve 15*a* of the opening/closing gun 15 into an open state by operating the lever 32, the water inside the pressurized tank 12 is guided to the opening/closing gun 15 via the fluid pipe 14. At this time, the compressed air introduced into the tank 12 by the air compressor 13 is also ejected into the gas-liquid mixing part 35 from the internal nozzle 38 of the gas pipe 37 provided at a position along the fluid pipe 14 from the gas outlet 25. In other words, when the pressurized water is guided to the gas-liquid mixing part 35 via the first supply flow path 51 and the pressurized air is guided to the gas-liquid mixing part 35 via the second supply flow path 52, the first supply flow path 51 and the second supply flow path 52 are joined in the gas-liquid mixing pan 35, the compressed air ejected from the internal nozzle 38 of the gas pipe 37 is mixed with the water flowing inside the fluid pipe 14, and the water is made into small drops. The internal nozzle 38 vibrates due to the exhaust of compressed air since it is formed into a flat shape and it is flexible. As a result, the water can be more effectively made into small drops.

The fluid in which the gas and liquid are mixed in this way is introduced into the branching side enlarged chamber 61 of the branching/joining part 58 via the internal opening/closing valve 15*a* and the base end side flow path 60, and introduced into each of the three branch flow paths 55-57 which are branched from the branching side enlarged chamber 61. The fluids flowing in each of the three branch flow paths 55-57 are introduced into the joining side enlarged chamber 65 of the branching/joining part 58 and join together by colliding with each other in the joining side enlarged chamber 65. As a result, the water is made into even smaller drops. This fluid is ejected toward the object to be washed from the external nozzle 33 via the front end side flow path 64 of the ejection flow path 53, and the object to be washed is washed.

In this case, the opening/closing amount of the fluid pipe 14 is adjusted by the adjustment valve 40 in accordance with need. By adjusting the flow rate of water with respect to the flow rate of compressed air to be introduced into the fluid pipe 14 by the gas pipe 37, it is possible to adjust the state of the water drops to a desired state, and the flow rate of water with respect to the flow rate of air is set so as to decrease it to a limit.

As described above, according to this fluid spraying device 11, as the water which has been made into small drops by mixing with air in the gas-liquid mixing part 35 is guided to the outside via the ejection flow path 53, it is branched into the plurality of branch flow paths 55-57 in the branching/joining part 58, these branch flow paths 55-57 then collide when rejoined, and the water is made into even smaller drops, Accordingly, it is possible to increase the washing performance by reducing the effect on the object to be washed, and it is possible to carry out effective washing with a small water volume. For example, when the object to be washed in an automobile, it is possible to remove deposits without having an effect on the coating surface of the automobile.

Figure 3:
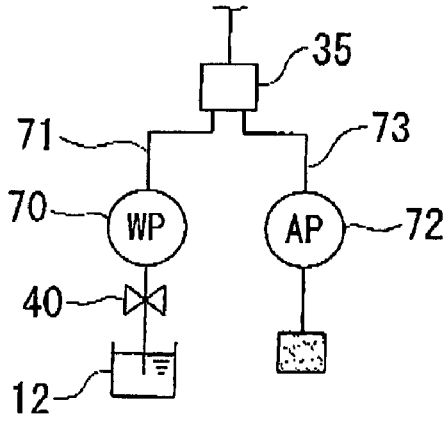

As shown in FIG. 3, the gas-liquid mixing part 35 may mix a first supply flow path 71 which guides a liquid pressurized by a liquid pump 70 with a second supply flow path 73 which guides a gas pressurized by a gas pump 72.

Furthermore, fluids which are joined after branching in the branching/joining part 58 may be directly ejected toward the object to be washed without providing the above-mentioned external nozzle 33.

In addition, instead of water, a liquid for coating such as a coating agent like titanium oxide may be introduced into the tank main body 21, and the fluid spraying device 11 may be used as a coating device for coating. In this case, as the liquid for coating which has been made into small drops by mixing with air in the gas-liquid mixing part 35 is guided to the outside via the ejection flow path 53, it is branched into the plurality of branch flow paths 55-57 in the branching/joining part 58, and these branch flow paths 55-57 then collide when rejoined. As a result, the liquid is made into even smaller drops, Accordingly, it is possible to increase the coating performance, and it is possible to carry out effective coating with a small liquid volume.

Figure 4:
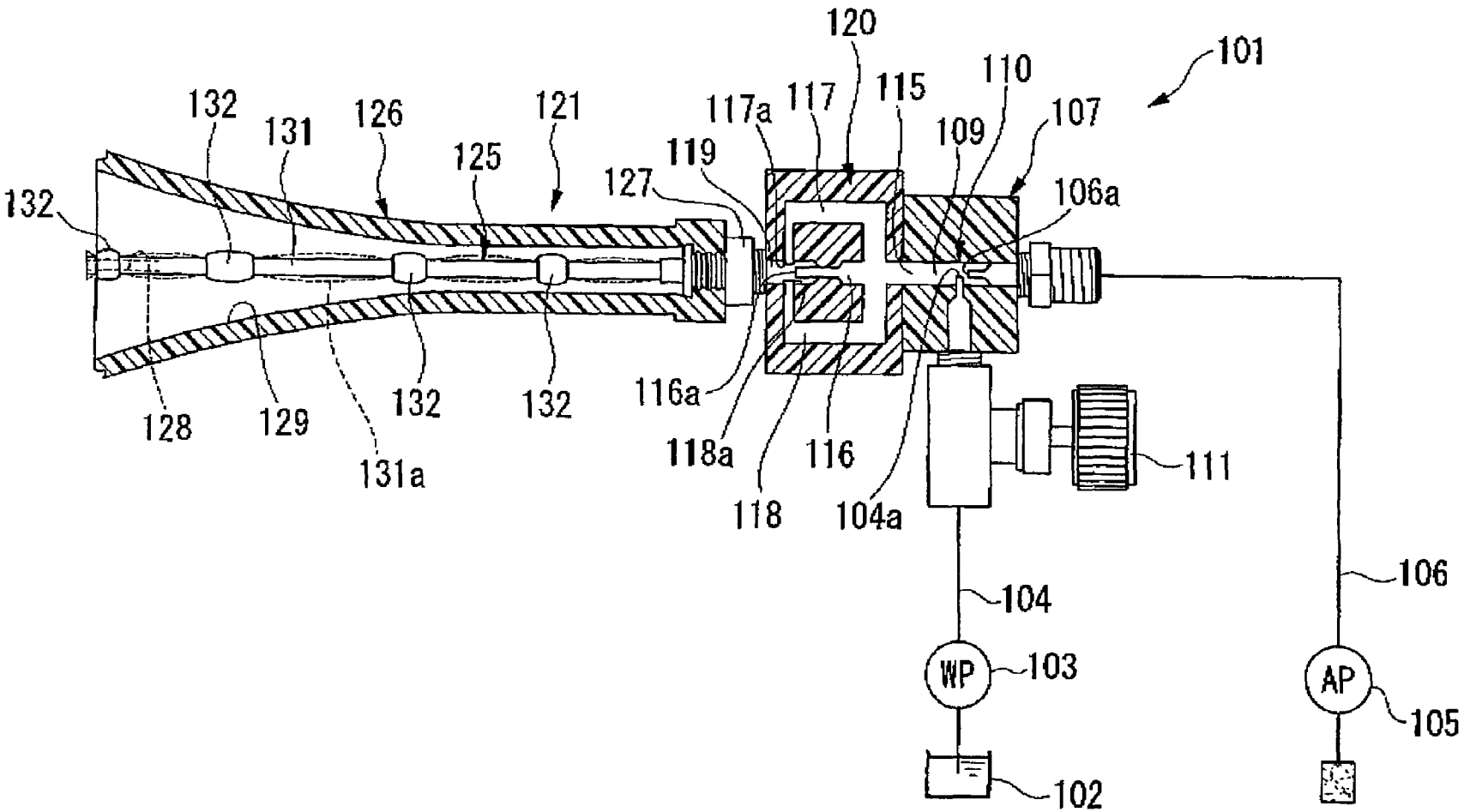
FIG. 4 is a cross-sectional diagram showing another example of the fluid spraying device of this invention.

A second embodiment of the fluid spraying device according to this invention will be explained below with reference to FIG. 4.

A fluid spraying device 101 also is used as a washing device for washing an automobile, for example. The fluid spraying device comprises a tank 102 which stores a liquid for washing comprising a detergent or water, a liquid pump 103 which pumps the liquid of the tank 102, a first supply flow path 104 which guides the liquid pressurized in the liquid pump 103, an air compressor 105 which pumps air (gas), a second supply flow path 106 which guides the air pressurized in the air compressor 105, and a nozzle 107 to which the first supply flow path 104 and the second supply flow path 106 are connected.

The nozzle 107 is connected to the first supply flow path 104 and the second supply flow path 106, and comprises a gas-liquid mixing part 110 which joins these flow paths. A liquid flow rate control valve 111 which controls the flow rate of the liquid supplied to the gas-liquid mixing part 110 from the first supply flow path 104 is provided between the gas-liquid mixing part 110 and the liquid pump 103 of the first supply flow path 104.

The gas-liquid mixing part 110 causes the liquid to be ejected from the first supply flow path 104 which has a tapered shape that projects into a mixing chamber 109 and the gas to be ejected from the second supply flow path 106 which has a tapered shape that projects into the same mixing chamber 109 to collide inside the mixing chamber 109, so that the liquid and the gas are mixed to form a gas-liquid mixture fluid. An opening part 104*a* of the first supply flow path 104 and an opening part 106*a* of the second supply flow path 106 are disposed at the front end sides of the flow paths so that their mutual axes are perpendicular. Accordingly, the liquid ejected from the first supply flow path 104 and the gas ejected from the second supply flow path 106 collide at an angle of 90 degrees.

At an intermediate part of an ejection flow path 115 which guides the gas-liquid mixture fluid mixed in the gas-liquid mixing part 110 to the outside, a branching/joining part 120 is provided which, after branching the ejection flow path 115 into a plurality (specifically, three) of branch flow paths 116-118, rejoins these three branch flow paths 116-118 inside a joining chamber 119. A nozzle main body 121 is provided even closer to the front end side of the branching/joining part 120.

In the branching/joining part 120, the gas-liquid mixture fluid to be ejected from the branch flow path 116 which has a tapered shaped that projects into the joining chamber 119 and the fluid to be ejected from the branch flow path 117 which has a tapered shaped that projects into the joining chamber 119 are made to collide with the fluid to be ejected from the branch flow path 118 which has a tapered shape that projects inside the joining chamber 119, and the fluids are mixed. Opening parts 117*a*, 118*a* of two branch flow paths 117, 118 are perpendicular to an opening part 116*a* of the remaining branch flow path 116, and these opening parts 117*a*, 118*a* oppose each other. Furthermore, all of the opening parts 116*a*, 117*a*, and 118*a* are disposed such that their mutual axes meet at one point at the front end sides thereof. As a result, the fluids ejected from the branch flow paths 117, 118 collide head on from directions which differ by 180 degrees, and the fluid ejected from the branch flow path 116 collides at the position of the head-on collision of the fluids from the branch flow paths 117, 118 from a direction which is perpendicular to these fluids.

In the branching/joining part 120, similar to the first embodiment, the fluids ejected from the branch flow paths 117, 118 also can be made to join together each forming an angle of about 45 degrees with respect to the gas-liquid mixture fluid ejected from the branch flow path 116.

The nozzle main body 121 is provided with a spray tube 125 comprising an elastic cylindrical body which constitutes the rear or downstream end of the ejection flow path 115, a cone-shaped guide 126 which is disposed outside of the spray tube 125 in the diametral direction so that the large diameter side is positioned at the front end side, and a support part 127 which supports the spray tube 125 and the guide 126.

In the nozzle main body 121, the gas-liquid mixture fluid which has been joined in the branching/joining part 120 is introduced into an ejection hole 128 of the spray tube 125 and ejected to the outside from the front end of the ejection hole 128. By means of a force of the gas-liquid mixture fluid occurring at this time, the spray tube 125 traverses at a high speed while being guided by an inner surface 129 of the guide 126.

The entirety of the spray tube 125 comprises a tube main body 131 comprising a tubular body, and is integrally formed with a uniform thickness from a flexible material of a synthetic resin such as nylon, Teflon (registered trademark), polyurethane, or polypropylene. The tube main body 131 is fixed to the support part 127 at one end. Furthermore, the ejection hole 128 formed inside the tube main body 131 has an inner diameter of 1 mm to 3 mm.

Moreover, the spray tube 125 comprises a plurality of weighting parts 132 which are fixed to the tube main body 131 at a prescribed spacing along the axial direction of the tube main body 131 in a state in which they are fit to the tube main body 131 from the outside. These weighting parts 132 are formed from metal, carbon, or ceramics, or from a synthetic resin such as nylon, Teflon (registered trademark), polyurethane, or polypropylene.

The weights of these weighting parts 132 differ from each other, and the spacings of the weighing parts 132 along the axial direction of the tube main body 131 are not uniform. Furthermore, the weighting parts 132 are formed into drum shapes in which both ends in the axial direction are made to have a smaller diameter than the center. These weighting parts 132 increase the weight of the spray tube 125 for the purpose of making the spray tube 125 traverse more efficiently. This is for preventing wear of the tube main body 131 due to contact of the spray tube 125 against the guide 126 as it traverses along the guide 126.

In the tube main body 131, by making the outer diameter of a portion where a weighting part 132 is not provided larger than the outer diameter of a portion where a weighting part 132 is provided, it is possible to prevent shifting of the weighting parts 132 in the axial direction. For example, as shown by reference symbol 131*a* in FIG. 4, the shape of the tube main body 131 may be a drum shape in which the outer diameter of a portion where a weighting part 132 is provided is a minimum, and the outer diameter of a portion where a weighting part 132 is not provided increases as the distance from the weighting parts 132 increases, and is a maximum at the central position between neighboring weighting parts 132.

The guide 126 is made from a synthetic resin having almost no flexibility, and is formed into a cone shape (so-called horn shape) where one end has a small diameter and increases to a large diameter as the position moves to the other end. In order to reduce the sliding resistance of the spray tube 125, at least the inner surface 129 of the guide 126 may be made from a metal material such as stainless steel, from ceramics, or the like. This guide 126 is fixed inside to the support part 127 at the small diameter side in a state in which the base end part of the spray tube 125 is disposed on the same axis.

An explanation will be made of the operation for the case when the fluid spraying device 101 having the above-mentioned constitution is used for washing.

First, the liquid pump 103 and the air compressor 105 are operated in a state in which a liquid for washing, specifically water, is introduced into the tank 102. The water inside the tank 102 is then pressurized and pumped to the first supply flow path 104, and air is compressed and pumped to the second supply flow path 106. The pressurized water is guided to the gas-liquid mixing part 110 via the first supply flow path 104, the pressurized air is guided to the gas-liquid mixing part 110 via the second supply flow path 106, and the water and air are mixed in the gas-liquid mixing part 110 which joins the first supply flow path 104 and the second supply flow path 106. As a result, the water is made into small drops by mixing the compressed air into the water. The gas-liquid mixture fluid containing such water made into small drops is next introduced into the branching/joining part 120, and introduced into each of the three branch flow paths 116-118 which are branched. The gas-liquid mixture fluids flowing through each of the three branch flow paths 116-118 collide with each other by being rejoined in the branching/joining part 120, so that the water is made into even smaller drops. This water is ejected to the outside, i.e., to the object to be washed, from the ejection hole 128 of the spray tube 125 which constitutes the rear end of the ejection flow path 115. At this time, due to the action of the gas-liquid mixture fluid which is ejected from the ejection hole 128, the spray tube 125 traverses along the cone-shaped guide 126 at a high speed.

By adjusting the liquid flow rate control valve 111 and adjusting the flow rate with respect to the flow rate of the compressed air in accordance with need, it is possible to adjust the state of the water drops to a desired state, and the flow rate of the water with respect to the flow rate of the air is set so as to decrease it to a limit.

As described above, according to this fluid spraying device 101, as the water which has been made into small drops by mixing with air in the gas-liquid mixing part 110 is guided to the outside via the ejection flow path 115, it is branched into the plurality of branch flow paths 116-118 in the branching/joining part 120, and these flow paths 116-118 then collide when rejoined. As a result, the water is made into even smaller drops. Accordingly, it is possible to increase the washing performance by reducing the effect on the object to be washed, and it is possible to carry out effective washing with a small water volume. For example, when the object to be washed is an automobile, it is possible to remove deposits without having an effect on the coating surface of the automobile.

Furthermore, when the gas-liquid mixture fluid which has been branched into the plurality of branch flow paths 116-118 in the branching/joining part 120 and then rejoined is ejected from the spray tube 125, the spray tube 125 is made to traverse along the cone-shaped guide 126 at a high speed. Accordingly, the gas-liquid mixture fluid to be ejected from the spray tube 125 traverses at a high speed (e.g., about 8,000 rpm) so as to shift the spraying position. As a result, for reasons such as being able to generate sonic vibrations (e.g., ultrasonic vibrations having a frequency of about 16-20 kHz) on the object to be washed, it is possible to further increase the washing performance.

In the branching/joining part 120, similar to the first embodiment, the fluids ejected from the branch flow paths 117, 118 can also be made to join together each forming an angle of about 45 degrees with respect to the gas-liquid mixture fluid ejected from the branch flow path 116.

Furthermore, instead of water, a liquid for coating such as a coating agent like titanium oxide may be introduced into the tank 102, and the fluid spraying device 101 may be used as a coating device for coating. In this case as well, as the liquid for coating which has been made into small drops by mixing with air in the gas-liquid mixing part 110 is guided to the outside via the ejection flow path 115, it is branched into the plurality of branch flow paths 116-118 in the branching/joining part 120, and these branch flow paths 116-118 the collide together when rejoined. As a result, the liquid is made into even smaller drops, Accordingly, it is possible to increase the coating performance, and it is possible to carry out effective coating with a small liquid volume. Moreover, the gas-liquid mixture fluid which is to be ejected from the spray tube 125 traverses at a high speed as the spraying position is shifted. As a result, it is possible to further increase the coating performance.

Figure 5:
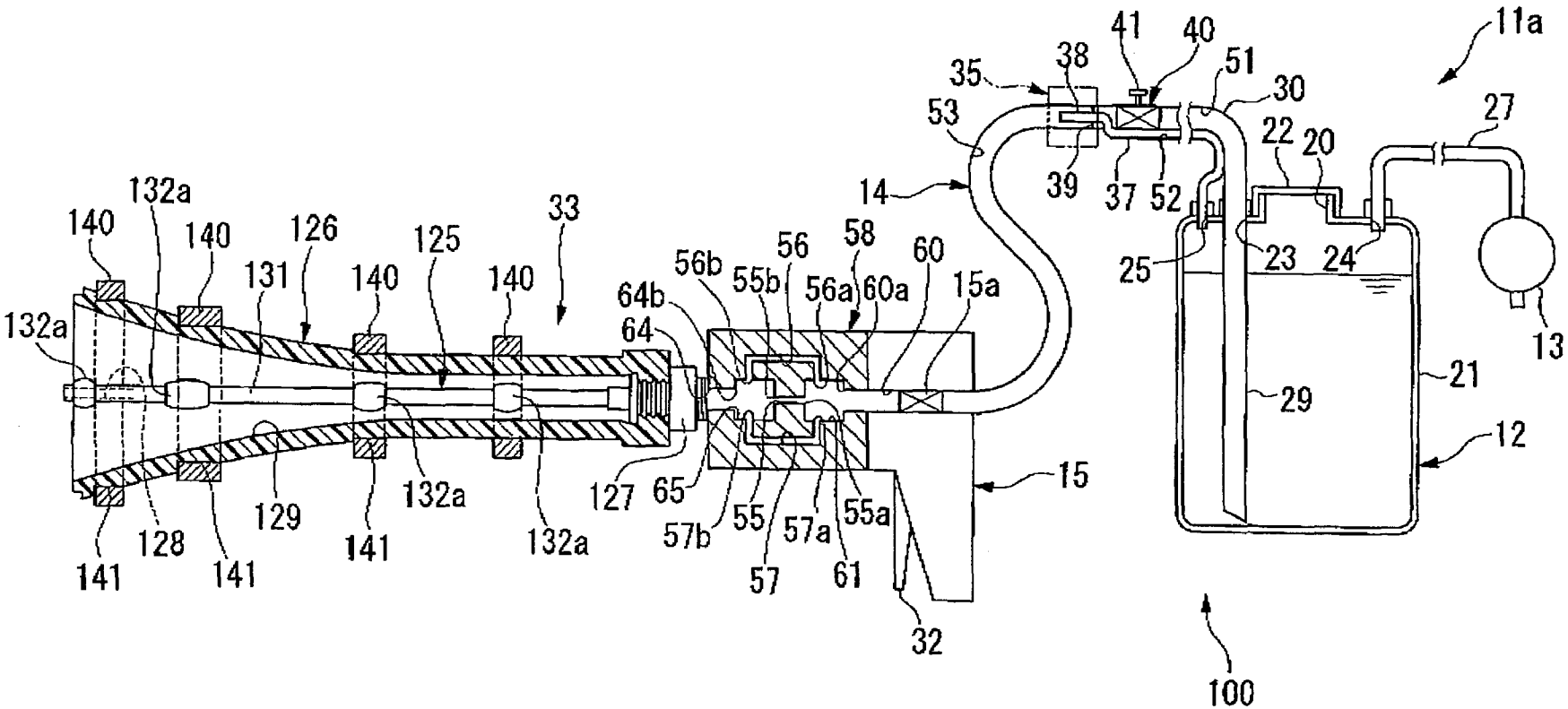
FIG. 5 is a cross-sectional diagram showing an example of a fluid spraying nozzle and a fluid spraying device using the fluid spraying nozzle of this invention.

A third embodiment of the fluid spraying device according to this invention will be explained below with reference to FIG. 5. In each of the following embodiments, portions having the same constitution and actions as those in the first and second embodiments shown in FIGS. 1 and 4 are appended with the same reference symbols as those used in FIGS. 1 and 4, and an explanation thereof is omitted.

In a fluid spraying device 11*a* of this embodiment the spray tube 125 of the fluid ejection nozzle 33 in the fluid spraying device having the same constitution as that of the first embodiment comprises a plurality of tube side magnets 132*a* which are fixed to the tube main body 131 at a prescribed spacing along the axial direction of the tube main body 131 in a state in which they are fit to the tube main body 131 from the outside. In these tube side magnets 132*a*, the polarities are aligned along the diametral direction, for example, the outer peripheral side has N polarity, and the inner peripheral side has S polarity.

The weights of these tube side magnets 132*a* differ from each other, and the spacings of the tube side magnets 132*a* along the axial direction of the tube main body 131 are not uniform. Furthermore, the tube side magnets 132*a* are formed into drum shapes in which both ends in the axial direction are made to have a smaller diameter than the center. These tube side magnets 132*a* increase the weight of the spray tube 125 for the purpose of making the spray tube 125 traverse more efficiently. As described below, this allows the spray tube 125 to traverse in a state in which there is no contact or almost no contact with the guide 126. In this embodiment as well, similar to the above-mentioned second embodiment, as shown by reference symbol 131*a* in FIG. 4, in the tube main body 131, by making the outer diameter of a portion where a tube side magnet 132*a* is not provided larger than the outer diameter of a portion where a tube side magnet 132*a* is provided, it is possible to prevent shifting of the tube side magnets 132*a* in the axial direction.

Moreover, in this embodiment, the outer diameter side of the guide 126 is provided with a plurality of ring-shaped guide side magnets 140 so as to be coaxial with the guide 126. By fitting these ring-shaped guide side magnets 140 onto the guide 126 at the inner peripheral side and adhering them in accordance with need, they are fixed to the guide 126. Moreover, in accordance with need, step parts 141 are formed on the guide 126 in order to make the guide side magnets 140 fit. In these guide side magnets 140, the polarities are aligned along the diametral direction, e.g., the outer peripheral side has S polarity, and the inner peripheral side has N polarity. In other words, the polarities of the outer peripheral side of the tube side magnets 132*a* and the polarities of the inner peripheral side of the guide side magnets 140 have the same polarity. Furthermore, the spacings of the guide side magnets 140 along the axial direction are set such that each of the guide side magnets 140 is positioned outside of each of the tube side magnets 132*a* in the diametral direction as the spray tube 125 traverses. Moreover, the lengths of each of the guide side magnets 140 along the axial direction are consistent with the lengths of the tube side magnets 132*a* along the axial direction which are positioned inside in the diametral direction as the spray tube 125 traverses.

An explanation will be made of the operation for the case when the fluid spraying device 11*a* having the above-mentioned constitution is used for washing.

The gas-liquid mixture fluid containing water, which has been made into small drops by mixing in the gas-liquid mixing part 35 and by joining and colliding in the branching/joining part 58, is introduced into the fluid ejection nozzle 33 via the front side flow path 64 of the ejection flow path 53, and ejected outside, i.e., toward the object to be washed, from the ejection hole 128 of the spray tube 125 of the fluid ejection nozzle 33. At this time, due to the action of the gas-liquid mixture fluid ejected from the ejection hole 128, the spray tube 125 traverses along the cone-shaped guide 126 at a high speed, and the ring-shaped tube side magnets 132*a* provided on the spray tube 125 are repelled due to the polarity of the ring-shaped guide side magnets 140 provided on the guide 126 which surrounds the spray tube 125 from the outside in the diametral direction. As a result, the spray tube 125 traverses in a state in which the sliding resistance is greatly reduced if there is no contact or even if there is contact with the guide 126.

In other words, according to this fluid spraying device 11*a*, since the sliding resistance of the spray tube 125 with respect to the guide 126 disappears or is greatly reduced, it is possible to further increase the traversing speed of the spray tube 125. As a result, the gas-liquid mixture fluid to be ejected from the spray tube 125 traverses at a high speed so as to shift the spraying position. Therefore, it is possible to generate sonic vibrations (e.g., ultrasonic vibrations) on the object to be washed. For reasons such as this, it is possible to further increase the washing performance. Furthermore, since water molecule clusters are reduced by the magnetic force when passing through the spray tube 125, it is possible to further improve the washing performance.

In a fluid pump 100, as water which has been made into small drops by mixing with air in the gas-liquid mixing part 35 is guided to the outside via the ejection flow path 53, it is branched into the plurality of branch flow paths 55-57 in the branching/joining part 58, and these branch flow paths 55-57 then collide when rejoined. As a result, the water drops are made even smaller. Accordingly, it is possible to further increase the washing performance by reducing the effect on the object to be washed, and it is possible to carry out even more effective washing with a small water volume. For example, when the object to be washed is an automobile, it is possible to remove deposits without having an effect on the coating surface of the automobile.

Furthermore, as shown in FIG. 3, the gas-liquid mixing part 35 may mix the first supply flow path 71 which guides the liquid that has been pressurized in the liquid pump 70 with the second supply flow path 73 which guides the gas that has been pressurized in the gas pump 72.

Moreover, a detergent may also be used as the liquid for washing instead of water.

In addition, instead of water, a liquid for coating such as a coating agent like titanium oxide may be introduced into the tank main body 21, and the fluid spraying device 11*a* may be used as a coating device for coating. In this case as well, since the spray tube 125 rotates at a high speed due to the repulsion between the tube side magnets 132*a* and the guide side magnets 140, it is possible to increase the coating performance, and it is possible to carry out effective coating with a small liquid volume. Moreover, as the liquid for coating which has been made into small drops by mixing with air in the gas-liquid mixing part 35 is guided to the outside via the ejection flow path 53, it is branched into the plurality of branch flow paths 55-57 in the branching/joining part 58, and these branch flow paths 55-57 then collide when rejoined. As a result, the liquid is made into even smaller drops. For this reason as well, it is possible to increase the coating performance, and it is possible to carry out effective coating with a small liquid volume.

Figure 6:
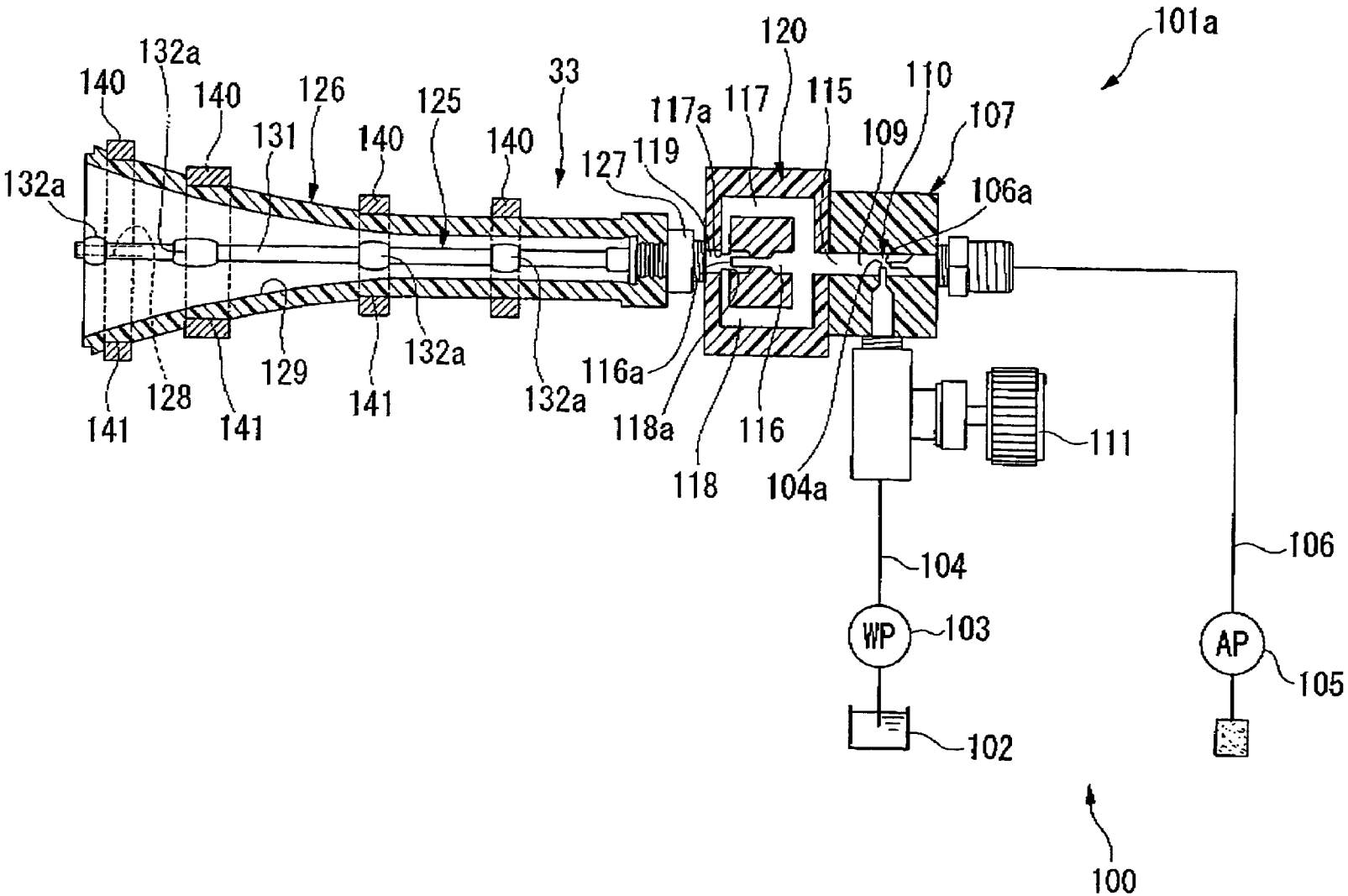
FIG. 6 is a cross-sectional diagram showing another example of a fluid spraying nozzle and a fluid spraying device using the fluid spraying nozzle of this invention.

A fourth embodiment of the fluid spraying device according to this invention will be explained below with reference to FIG. 6. In a fluid spraying device 101*a* of this embodiment, similar to the third embodiment, the fluid ejection nozzle 33 in the fluid spraying device having the same constitution as that of the second embodiment is constituted such that a ring-shaped tube side magnet 132*a* is provided on the spray tube 125, and a ring-shaped guide side magnet 140 is provided on the guide 126.

For the case when the fluid spraying device 101*a* having the above-mentioned constitution is used for washing, the gas-liquid mixture fluid containing water, which has been made into small drops by mixing in the gas-liquid mixing part 110 and by joining and colliding in the branching/joining part 120, is ejected to the outside, i.e., toward the object to be washed, from the ejection hole 128 of the spray tube 125. At this time, due to the action of the gas-liquid mixture fluid ejected from the ejection bole 128, the spray tube 125 traverses along the cone-shaped guide 126 at a high speed, and the ring-shaped tube side magnet 132*a* provided on the spray tube 125 is repelled due to the polarity of the ring-shaped guide side magnet 140 provided on the guide 126 which surrounds the spray tube 125 from the outside in the diametral direction. As a result, the spray tube 125 traverses in a state in which the sliding resistance is greatly reduced if there is no contact or even if there is contact with the guide 126.

The same effects as those of the second and third embodiments are also exhibited by the fourth embodiment as described above.

A detergent may also be used as the liquid for washing instead of water.

Furthermore, instead of water, a liquid for coating such as a coating agent like titanium oxide may be introduced into the tank 102, and the fluid spraying device 101*a* may be used as a coating device for coating.

Moreover, in the fluid spraying devices of the invention (the fluid spraying devices 11, 11*a*, 101, and 101*a*, for example), when the detergent or a water-repellent agent is blown onto the surface of an article, the detergent or the water-repellent agent is turned into a fine form and attached to the surface of an article. As a result, retention time of the detergent or the water-repellent agent onto the surface of an article is prolonged, and therefore, the efficiency of the detergent or the water-repellent agent is promoted.

In addition, since a fine liquid is blown onto the surface of the article at a high speed, it is also possible to use the fluid spraying devices of the invention for washing glass and coating a medicine onto a tool surface, or the like. It is also possible to carry out coating. Moreover, since a gas-liquid mixture fluid to be ejected from the spray tube 125 traverses at a high speed as the spraying position is shifted, it is possible to further increase the coating performance.

Furthermore, by changing the type of liquid to be sprayed onto the surface of the article during operation, it is possible to continuously carry out washing of the article and coating of a medicine onto a surface of the article with the same device. For example, when using the fluid spraying devices of the invention for washing the automobile, by changing the type of liquid to be sprayed onto the surface of the automobile during operation to water, the detergent, water, and the water-repellent agent, with this order, it is possible to continuously and quickly carry out washing of the coating surface of the automobile and coating of the water-repellent agent on the coating surface of the automobile with the same device.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A fluid spraying device comprising:

a first supply flow path which guides a pressurized liquid;

a second supply flow path which guides a pressurized gas;

a gas-liquid mixing part which joins said first supply flow path and said second supply flow path and which mixes said liquid and said gas;

an ejection flow path which guides a fluid from said gas-liquid mixing part to a branching/joining part;

said branching/joining part being provided at an intermediate part of said ejection flow path which, after branching said ejection flow path into a plurality of branch flow paths, rejoins said branch flow paths together; and a flexible spray tube which constitutes a downstream end of said ejection flow path, and a cone-shaped guide which is disposed outside of said spray tube in the diametral direction so that a large diameter side is positioned at a downstream end side, wherein said spray tube comprises a tube main body made of a flexible material, and a plurality of weighting parts which fit said tube main body from the outside and which are fixed to said tube main body at a prescribed spacing along an axial direction of said tube main body.

2. A fluid spraying device according to claim 1, wherein at least an inner peripheral surface of said guide is made of metal or ceramics.

3. A fluid spraying device according to claim 1, wherein weights of said weighting parts differ from each other.

4. A fluid spraying device according to claim 1, wherein an outer diameter of a portion of said tube main body where said weighting part is not provided is larger than an outer diameter of a portion of said tube main body where said weighting part is provided.

* * * * *